United States Patent [19]

Choi et al.

[11] 4,055,486

[45] Oct. 25, 1977

[54] METHOD AND APPARATUS FOR HANDLING SOLID FLUIDIZED PARTICLES

[75] Inventors: Charles K. Choi, Claremont; Joseph P. Tassoney, Diamond Bar, both of Calif.

[73] Assignee: Occidental Petroleum Corporation, Los Angeles, Calif.

[21] Appl. No.: 710,109

[22] Filed: July 30, 1976

Related U.S. Application Data

[63] Continuation of Ser. No. 603,871, Aug. 11, 1975, abandoned.

[51] Int. Cl.[2] ..... B07B 9/02

[52] U.S. Cl. ..... 209/11; 209/19; 209/20; 209/138; 209/144; 209/474

[58] Field of Search ..... 209/11, 19, 20, 138, 209/139 R, 144, 146, 147, 150, 474–477; 23/230 PC, 253 PC, 288 S; 432/16; 110/8 F; 55/345; 34/10, 57 A; 208/127, 150, 151, 163, 164; 201/3, 12, 22, 25, 31, 39, 42; 202/121; 196/127; 423/453, 454, 449, 461

[56] References Cited

U.S. PATENT DOCUMENTS

| | | | |
|---|---|---|---|
| 2,754,966 | 7/1956 | Kollgaard et al. | 209/139 R |
| 2,779,719 | 1/1957 | Spitz et al. | 209/139 R X |
| 2,929,774 | 3/1960 | Smith | 23/288 S X |
| 3,206,392 | 9/1965 | Scheuermann et al. | 209/138 X |
| 3,677,715 | 7/1972 | Morrison et al. | 34/57 A X |
| 3,702,516 | 11/1972 | Luckenbach | 208/127 X |
| 3,817,872 | 6/1974 | Evans et al. | 23/288 S X |
| 3,849,899 | 11/1974 | Jenkinson | 23/288 S X |

*Primary Examiner*—Frank W. Lutter

*Assistant Examiner*—Ralph J. Hill

*Attorney, Agent, or Firm*—Christie, Parker & Hale

[57] ABSTRACT

A source of fluid and entrained particles including fines is connected to the entrance of a cyclone particle separator lying above a particle storage vessel that has an outlet near its bottom. The particle separator has a particle exit connected to the storage vessel and a fluid exit. The separator imparts angular motion to the fluid received at its entrance such that the fluid with a first percentage of the fines entrained therein flows out the fluid exit, and the particles minus such first percentage passes through the particle exit to the storage vessel. The particles in the storage vessel are fluidized to a particular level above the outlet. Fluidized particles with a second percentage of the fines entrained therein are removed from the process by withdrawal from the storage vessel at a point between the particular level and the outlet. Fluidized particles minus the first and second percentages of the fines flow from the outlet of the storage vessel to a receiver for processing. The average size of the fluidized particles leaving the outlet is controlled by changing one of the percentages of the fines. When the quantity of fines included in the fluid entrained particles from the source becomes too great, the angular operation of the separator is disrupted by injecting fluid into its base, or by raising the level of fluidized particles in the storage vessel to increase the percentage of the fines flowing out the fluid exit of the separator. When the quantity of fines included in the fluid entrained particles from the source decreases, a portion of the fines withdrawn from the storage vessel is returned to the storage vessel to decrease the second percentage.

35 Claims, 8 Drawing Figures

METHOD AND APPARATUS FOR HANDLING SOLID FLUIDIZED PARTICLES

CROSS REFERENCE TO RELATED APPLICATIONS

This is a continuation of application Ser. No. 603,871, filed Aug. 11, 1975 now abandoned.

BACKGROUND OF THE INVENTION

This invention relates to particle handling and, more particularly, to a method and apparatus for controlling the average size of fluidized particles leaving a storage vessel.

In some chemical processes, it is necessary to exercise control over the average size of solid particles fed to a reaction zone. One example is a pyrolysis process in which a particulate heat source is transported through a pyrolysis reactor with comminuted organic material under turbulent flow conditions to provide the heat transfer needed for pyrolysis of the organic material. The system including the pyrolysis reactor is designed to provide a sufficient residence time in the reactor to raise the organic material to a desired temperature. If the particulate heat source includes too many fines, it is difficult to fluidize and circulate as a unit mass. If the average particle size is too great, total surface area will be low, and the mass will have a low transfer efficiency.

SUMMARY OF THE INVENTION

According to the invention, control is exercised over the average size of fluidized particles in a storage vessel to be used in a process such as pyrolysis, by changing the percentage of fines separated from the particles prior to their entry into the storage vessel, or by changing the percentage of fines in a portion of the particles removed from the storage vessel.

In the apparatus of the invention, a particle storage vessel has an outlet near its bottom. A particle separator has an entrance lying above the storage vessel, a fluid exit, and a particle exit connected to the storage vessel. The entrance of the particle separator is connected to a source of fluid and entrained particles including fines, such as a char burner. The separator imparts angular motion to the fluid received at its entrance from the source such that the fluid with a first percentage of the fines entrained therein flows out the fluid exit and the particles minus such first percentage pass through the particle exit to the storage vessel. The particles in the storage vessel are fluidized to a particular level above its outlet. Fluidized particles with a second percentage of the fines entrained therein are removed from the process by withdrawal from the storage vessel at a point between the particular level and the outlet. Fluidized particles minus the first and second percentages of the fines flow from the outlet of the storage vessel to a receiver, such as a pyrolysis reactor, for use. Apparatus is provided to control the first percentage of the fines removed by the particle separator and the second percentage of the fines removed from the process by withdrawal from the storage vessel.

The method of the invention comprises operating the apparatus described in the preceding paragraph to increase the first percentage when the quantity of fines included in the fluid entrained particles from the source increases, and decreasing the second percentage when the quantity of fines included in the fluid entrained particles from the source decreases. Specifically, the first percentage is increased by disrupting the angular motion of the fluid in the separator, and the second percentage is decreased by returning a portion of the withdrawn fines to the storage vessel.

BRIEF DESCRIPTION OF THE DRAWINGS

The features of a specific embodiment of the best mode contemplated of carrying out the invention are illustrated in the drawings, in which.

DETAILED DESCRIPTION OF THE SPECIFIC EMBODIMENT

Although the invention is described in conjunction with apparatus for carrying out a pyrolysis process, and is particularly useful in such application, it has general applicability to handling solid fluidized particles, irrespective of their nature or the nature of the chemical process. Particulate char, which may be obtained as one of the products of pyrolysis, reacts with air in a char burner 10 to form only hot ash or a combination of hot ash and char. For the purposes of discussion, it is assumed char burner 10 forms essentially only ash. Char burner 10 serves as a source of fluid, i.e., flue gas from combustion, and entrained particles, i.e., ash, including fines.

Figure 1:
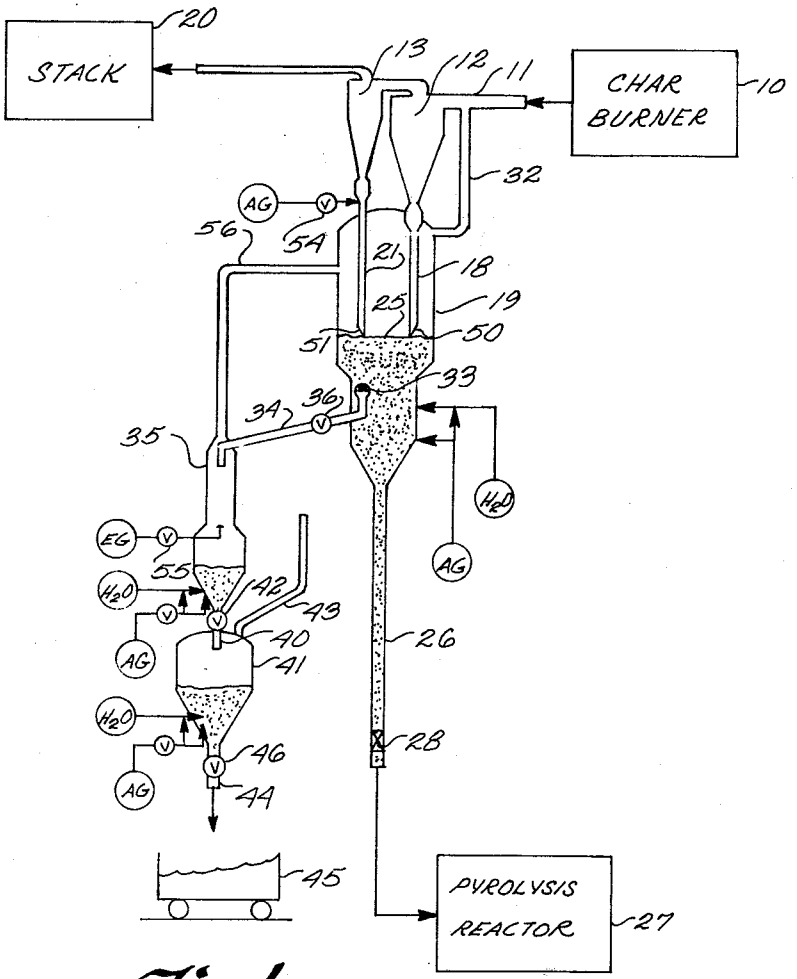
FIG. 1 is a schematic diagram of apparatus incorporating the principles of the invention.

Char burner 10 is connected by a conduit 11 to the entrance of a cyclone particle separator 12. Separator 12 has a fluid exit connected to the entrance of a cyclone particle separator 13, and a particle exit connected by a dipleg 18 to the interior of an ash surge hopper 19, which serves as a particle storage vessel. Separator 13 has a fluid exit connected to a stack 20, and a particle exit connected by a dipleg 21 to the interior of surge hopper 19. Angular motion is imparted to the fluid received at the entrance of each of separators 12 and 13 to separate the particles therefrom by centrifugal force; the fluid with a percentage of the fines entrained therein flows out the respective fluid exits and the particles minus such percentage of the fines pass through the particle exits to surge hopper 19 via the corresponding diplegs. Separator 12 removes the coarser particles from the fluid, and separator 13 removes the finer particles from the fluid Aeration gas from a source designated in FIG. 1 by the encircled letters "AG", is introduced into the bottom of hopper 19 to maintain the particles therein in a dense fluidized state. The aeration gas could be air if combustion is desired in hopper 19, or inert gas resulting from pyrolysis if no combustion is desired in hopper 19. A water mist created by mixing aeration gas with water from a source designated by the encircled "$H_2O$", is also introduced into the bottom of hopper 19 as a quench, if desired. The bed of fluidized particles extends from the bottom of hopper 19 up to a level 25 that is approximately at the bottom of diplegs 18 and 21. A flapper valve 50 and a flapper valve 51 are mounted at the bottom of diplegs 18 and 21, respectively. Flapper valves 50 and 51 are spring biased toward the closed position, are normally maintained open by the small pressure difference thereacross, and close when such pressure difference decreases below a predetermined level to prevent reverse flow up through diplegs 18 and 21, respectively, from hopper 19 to separators 12 and 13, respectively. Hopper 19 has an outlet near its bottom, preferably at its bottom. A standpipe 26 extends downwardly from the outlet of hopper 19.

The bottom of standpipe 26 is connected to a pyrolysis reactor 27, which serves as a receiver of the fluidized particles flowing from the outlet of hopper 19. The flow of fluidized particles from the outlet of hopper 19 to pyrolysis reactor 27 is controlled by the setting of a slide valve 28 at the bottom of standpipe 26. The hot fluidized particles supplied by hopper 19 transfer heat to comminuted solid organic waste in pyrolysis reactor 27, thereby pyrolysis such organic waste. Conduit 11, separators 12 and 13, hopper 19, and standpipe 26 are all lined with a refractory material to withstand and maintain the high temperature of the fluidized particles. If desired, the char product of the pyrolysis could be returned to char burner 10 for combustion, thereby closing the loop of the process. Product gas resulting from the pyrolysis may be employed as the aeration gas.

Extremely fine particles that find their way into hopper 19 are lifted to the top of hopper 19 by the aeration gas, from which point they are carried by a return line 32 to conduit 11 for passage with the flue gas through separators 12 and 13 to stack 20.

A screened withdrawal point 33 is positioned in the fluidized particles between level 25 and the outlet of hopper 19. A withdrawal conduit 34 connects withdrawal point 33 to a cooling drum 35, which is at a lower pressure than the bed of fluidized particles in hopper 19. Fluidized particles are continuously withdrawn from the bed in hopper 19 via withdrawal point 33 and conduit 34 at a rate controlled by the setting of a valve 36. The withdrawn particles are removed from the pyrolysis process.

Aeration gas is introduced into the bottom of cooling drum 35 to further fluidize the particles. In addition, a water mist is introduced into the bottom of cooling drum 35 to cool the hot ash particles. The outlet at the bottom of cooling drum 35 is connected by a conduit 40 to the top of a trim cooler 41. The rate of flow of fluidized particles to trim cooler 41 is controlled by the setting of a valve 42. Aeration gas is introduced into the bottom of trim cooler 41 to fluidize the particles therein. A vent 43 connects the top of trim cooler 41 to a stack such as stack 20. A water mist is also introduced into the bottom of trim cooler 41 to further cool the ash particles to a temperature near ambient. The cooled particles pass from the bottom of trim cooler 41 as product ash through a conduit 44 to a vehicle 45 for removal from the site. The rate of removal of particles from trim cooler 41 is controlled by the setting of a valve 46.

In some chemical processes, it is important to control the average size of solid fluidized particles. For example, in a pyrolysis process if the average size of the solid particulate heat source is too small, the particles are difficult to fluidize and transport as a unit mass. If the average particle size is too large, heat transfer is inefficient. A typical size distribution by percentage by weight of the particles leaving char burner 10 is as follows:

| Size | Percentage by Weight |
|---|---|
| 0 ~ 10 microns | 1.2 |
| 10 ~ 20 | 7.8 |
| 20 ~ 40 | 13.0 |
| 40 ~ 80 | 16.0 |
| 80 ~ 120 microns | 18.0 |
| 120 ~ 160 | 13.0 |
| 160 ~ 200 | 10.0 |
| 200 ~ 400 | 15.0 |
| 400 ~ 600 | 2.5 |
| 600 ~ 1000 | 2.0 |
| 1000 ~ 2000 | 1.5 |
| 2000 + | 0.0 |

The size of the particles leaving char burner 10 is monitored by periodically sampling the particles in conduit 11 or hopper 19. If these particles include too many fines, the percentage of fines entrained in the fluid flowing out the fluid exit of separators 12 and 13 to stack 20 is increased in one of two ways to increase the average particle size in hopper 19. The first way is to open a valve 54 to introduce aeration gas into the top of dipleg 21 at a low flow rate to disrupt the angular motion of the fluid flowing through separator 13 and, thus, separate fewer fines from the fluid by centrifugal force. The second way is to raise level 25 by closing valve 36 slightly. This causes the level of fluidized particles in diplegs 18 and 21, which is higher than level 25, to move up diplegs 18 and 21. As a consequence, the angular motion of the fluid flowing through separators 12 and 13 is disrupted and thus fewer fines are separated from the fluid by centrifugal force. If the particles leaving char burner 10 include too few fines, valve 36 is opened further to increase the flow rate of fluidized particles withdrawn by conduit 34, and a valve 55 is opened to introduce an elutriating gas into cooling drum 120. The elutriating gas lifts fines withdrawn by conduit 34 upwardly through a return line 56 to the top of hopper 19. Thus, some of the withdrawn fines are returned to hopper 19 to decrease the net percentage of fines withdrawn from hopper 19 by conduit 34, i.e., the percentage of fines removed from the process, and decrease the average particle size in vessel 19.

For example, assume the above size distribution table represents the normal particle size leaving char burner 10, and the approximate desired particle size of the fluidized heat source supplied to pyrolysis reactor 27. In such case, the average particle size in hopper 19 is between 80 and 120 microns. The size distribution of the particles, e.g., ash, may change as the composition of the organic material varies. If the size distribution of the particles leaving char burner 10 changes in such a manner that substantially more particles smaller than 80 microns are present, the percentage of fines entrained in the fluid flowing out the fluid exit of separators 12 and 13 to stack 20 is increased proportionately in one of the above described ways so the average size of the fluidized particles in hopper 19 remains approximately the same, i.e., between 80 and 120 microns. If the size distribution of the particles leaving char burner 10 changes in such a manner that substantially more particles larger than 120 microns are present, then a smaller percentage of the particles smaller than 80 microns is removed from the process by returning such particles to hopper 19 through return line 56. This increases the percentage of smaller particles in hopper 19 to balance the number of larger particles, thereby maintaining approximately the same average particle size. The flow rate of particles withdrawn through conduit 34 is also increased to compensate for the particles returned through line 56, so the net weight per hour of particles removed from the process remains the same.

Figure 2B:
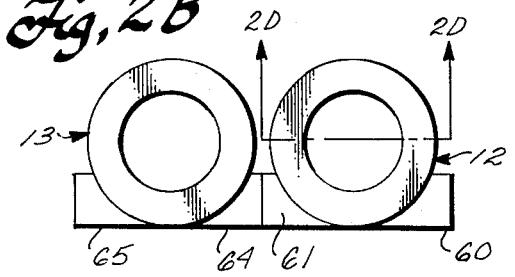
FIGS. 2A, 2B, 2C, and 2D are side elevation, top plan, bottom sectional, and side sectional views, respectively, of the cyclone separators depicted schematically in FIG. 1.
Figure 2A:
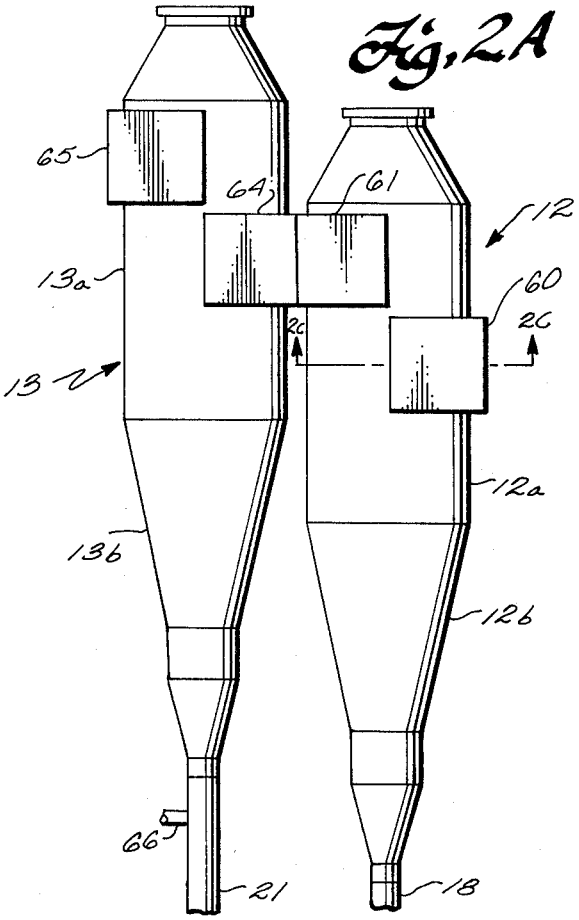
Figure 2C:
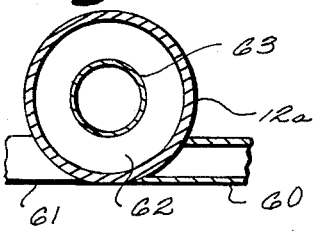
Figure 2D:
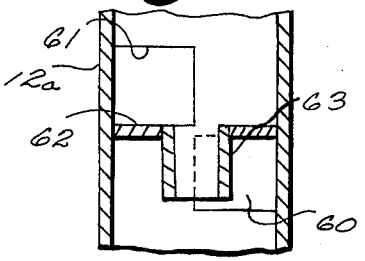

Reference is made to FIGS. 2A through 2D for a description of separators 12 and 13. Cyclone separators 12 and 13 have hollow cylindrical top portions 12*a* and 13*a*, respectively, and hollow tapered bottom portions 12*b* and 13*b*, respectively, that are connected to the tops of diplegs 18 and 21, respectively. Conduit 11 (not shown) is connected to an inlet 60 that opens tangentially into portion 12*a*. An outlet 61 opens tangentially into portion 12*a* above inlet 60. As depicted in FIGS. 2C and 2D, a disc-shaped divider 62 extends across portion 12*a* between inlet 60 and outlet 61, and a short cylindrical conduit extends downwardly from divider 62 to provide a fluid flow path between inlet 60 and outlet 61. Outlet 61 is connected to an inlet 64 of separator 13 that opens tangentially into portion 13*a*. An outlet 65, which is connected to stack 20, opens tangentially into portion 13*a* above inlet 64. A divider and short conduit constructed as shown in FIGS. 2C and 2D are provided within portion 13*a*. Inlets 60 and 64 each serve as the entrance to the corresponding separator, outlets 61 and 65 each serve as the fluid exit of the corresponding separator, and diplegs 18 and 21 each serve as the particle exit of the corresponding separator. Angular motion is imparted to fluid flowing through inlet 60 into portion 12*a* by virtue of its cylindrical side wall to separate particles therefrom by centrifugal force. The particles drop down along the walls of portion 12*a* and the walls of portion 12*b* to dipleg 18, while the fluid flows inwardly to conduit 63 and up through to outlet 61. The particles are removed from the fluid by virtue of the fluid movement. The aeration gas to disrupt this fluid movement in separator 13 to increase the percentage of fines entrained in the fluid flowing out the fluid exit is introduced through an inlet 66 near the top of dipleg 21.

Figure 3:
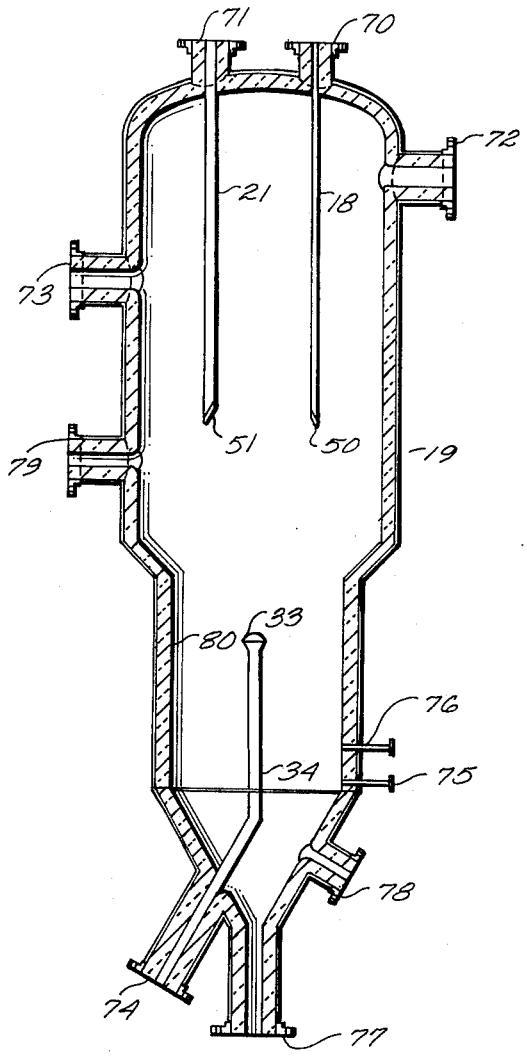
FIG. 3 is a side sectional view of the surge hopper depicted schematically in FIG. 1.

Reference is made to FIG. 3 for a description of surge hopper 19. Diplegs 18 and 21 enter hopper 19 through ports 70 and 71, respectively, return line 32 is connected to the interior of hopper 19 by a port 72, return line 56 is connected to the interior of hopper 19 by a port 73, and withdrawal conduit 34 enters hopper 19 through a port 74. Aeration gas to form the bed of fluidized particles is introduced into the interior of hopper 19 through a plurality (e.g., eight) of nozzles 75 distributed at equal intervals (e.g., at 45° intervals) around hopper 19. Water mist is introduced into the interior of hopper 19 through a plurality (e.g., four) of nozzles 76 distributed at equal intervals (e.g., 90° intervals) around hopper 19. A port 77, which serves as the outlet of hopper 19, is connected to standpipe 26 (not shown). The interior of hopper 19 has a refractory lining 80. For the purposes of start-up of the pyrolysis process only, an inert aeration gas in introduced into the bottom of hopper 19 through a port 78, and hot particles from a loading tank are introduced into the side of hopper 19 through a port 79.

Figure 4:
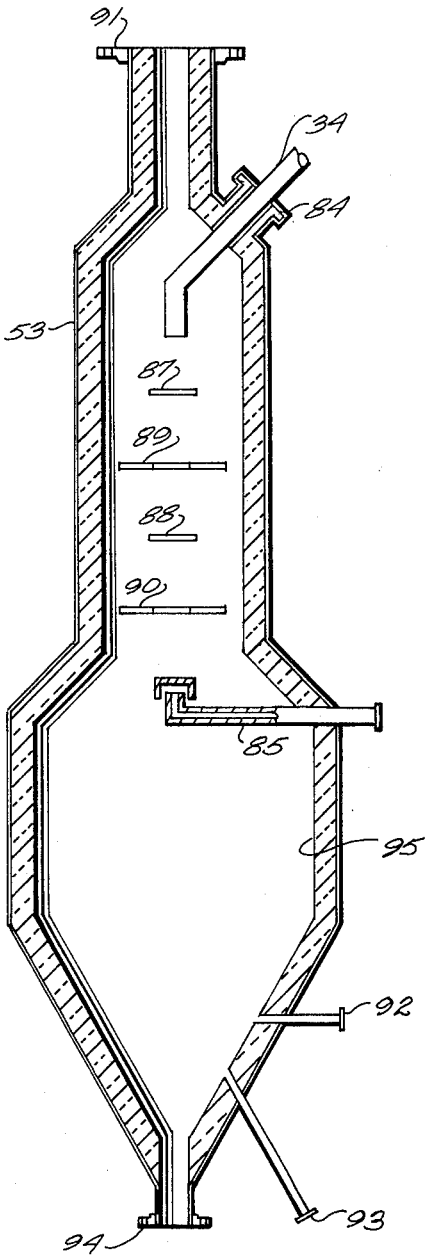
FIG. 4 is a side sectional view of the cooling drum depicted schematically in FIG. 1.

Reference is made to FIG. 4 for a description of cooling drum 35. Withdrawal conduit 34 enters cooling drum 35 through a port 84. A feedline 85, which is connected to the source of elutriating gas, extends into the middle of drum 35. A cap 86 overlies the open end of feedline 85 to protect it from downwardly moving paticles. Between the exit of withdrawal line 34 and feedtine 85, solid discs 87 and 88 and rings 89 and 90 are disposed to provide a uniform distribution of the upwardly flowing elutriating gas and the downwardly moving particles leaving withdrawal conduit 34. More efficient elutriation of fines back to hopper 19 results. Return line 56 is connected to the interior of drum 53 by a port 91. Aeration gas is introduced into the interior of drum 53 by a plurality (e.g., four) of nozzles 92, distributed at equal intervals (e.g., at 90° intervals) around drum 53. Water mist is introduced into the interior of drum 53 by a nozzle 92. A port 94, which serves as the outlet of drum 53, is connected to conduit 40. The interior of drum 53 has a refractory lining 95.

Figure 5:
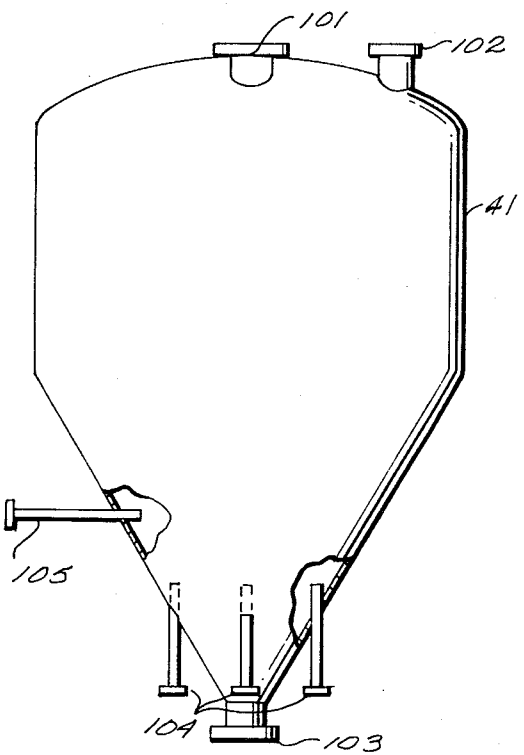
FIG. 5 is a side sectional view of the trim cooler depicted schematically in FIG. 1.

Reference is made to FIG. 5 for a description of trim cooler 41. Conduit 40 enters trim cooler 41 through a port 101, vent 43 is connected to the interior of trim cooler 41 through a port 102, and conduit 44 is connected to the interior of trim cooler 41 through a port 103, which serves as the outlet of trim cooler 41. Aeration gas is introduced into the interior of trim cooler 41 by a plurality (e.g., four) of nozzles 104 distributed at equal intervals (e.g., at 90° intervals) around trim cooler 41. Water mist is introduced into the interior of trim cooler 41 by a nozzle 105.

In one embodiment of the invention, the normal operating conditions are as follows: Temperature in Fahrenheit — 1350° in conduit 11, 1350° in hopper 19 above level 25, 1400° in hopper 19 at the bottom of the bed of fluidized particles, 1345° at the bottom of standpipe 26, 1350° in conduit 34, 1300° in return line 56, 1300° in cooling drum 35 above the bed of fluidized particles, 350° in cooling drum 35 at the bottom of the bed of fluidized particles, 300° in trim cooler 41 above the bed of fluidized particles, and 200° in trim cooler 41 at the bottom of the bed of fluidized particles; Pressure — 9.3 psig in conduit 11, 9.9 psig in hopper 19 above the bed of fluidized particles, 16 psig in hopper 19 at the bottom of the bed of fluidized particles, 21.7 psig at the bottom of standpipe 25, 14 psig in cooling drum 35 above the bed of fluidized particles, and 5 psig in trim cooler 41 at the bottom of the bed of fluidized particles; and bulk (apparent) density of the fluidized particles — 5 lbs/ft$^3$ at the top of hopper 19, 60 lgs/ft$^3$ in hopper 19 in the bed of fluidized particles, and 65 lbs/ft$^3$ in standpipe 26.

The described embodiment of the invention is only considered to be preferred and illustrative of the inventive concept; the scope of the invention is not to be restricted to such embodiment. Various and numerous other arrangements may be devised by one skilled in the art without departing from the spirit and scope of this invention. For example, although the invention is of particular advantage in the disclosed pyrolysis process, it can be used to advantage in other processes in which the control of the size of fluidized particles is important. Further, the invention also could be practiced by using a single control parameter to both increase and decrease the average particle size. For example, the cyclone separators could be operated so the angular motion of the fluid passing therethrough is disrupted when the particles leaving char burner 10 have the normal particle distribution; then, when the average particle size increases, the angular motion of the fluid passing through the cyclone separators is disrupted less, and when the average particle size decreases, the angular velocity of the fluid passing through the cyclone separators is disturbed more. Similarly, instead of disturbing the angular motion of the fluid passing through the cyclone separators, the elutriating gas could be introduced into the cooling drum on a continuous basis, more elutriating gas being used when the average particle size increases and less elutriating gas being used when the average particle size decreases.

What is claimed is:

1. Apparatus for handling solid fluidized particles, the apparatus comprising:

a source of fluid and entrained particles including fines;

a particle storage vessel having an outlet near its bottom;

a particle separator having an entrance lying above the storage vessel and connected to the source, a fluid exit, a particle exit connected to the storage vessel, and means for separating particles from fluid received at the entrance such that the fluid with a first percentage of the fines entrained therein flows to the fluid exit and the particles minus the first percentage of the fines pass through the particle exit to the storage vessel;

means for fluidizing the particles in the storage vessel to a particular level above the outlet;

means for removing fluidized particles with a second percentage of the fines entrained therein from the storage vessel at a point between the particular level and the outlet;

a receiver connected to the outlet of the storage vessel to receive fluidized particles minus the first and second percentages of the fines flow from the outlet of the storage vessel; and means for changing at least one of the percentages of the fines.

2. The apparatus of claim 1, in which the changing means comprises means for increasing the first percentage.

3. The apparatus of claim 2, in which the particle separator comprises one or more cyclone particle separators imparting angular motion to the fluid received at the entrance to separate particles by centrifugal force, and the increasing means comprises means for disrupting the angular motion imparted to the fluid received at the entrance.

4. The apparatus of claim 3, in which the disrupting means comprises means for introducing a gas at a low flow rate into the cyclone particle separator.

5. The apparatus of claim 4, in which the changing means additionally comprises means for decreasing the second percentage by returning to the storage vessel a portion of the fines removed therefrom by the removing means.

6. The apparatus of claim 3, in which the disrupting means comprises means for raising the particular level of the fluidized particles in the storage vessel into the particle exit of the cyclone particle separator.

7. The apparatus of claim 6, in which the changing means additionally comprises means for decreasing the second percentage by returning to the storage vessel a portion of the fines removed therefrom by the removing means.

8. The apparatus of claim 6, in which the particle outlet comprises a dipleg extending downwardly into the storage a vessel to a point in the vicinity of the particular level, and a flapper valve on the end of the dipleg that closes to prevent reverse flow from the storage vessel through the dipleg to the particle separator.

9. The apparatus of claim 1, in which the changing means comprises means for decreasing the second percentage.

10. The apparatus of claim 9, in which the decreasing means comprises means for returning to the storage vessel a portion of the fines in the fluidized particles removed by the removing means.

11. The apparatus of claim 10, in which the removing means comprises a drum at a lower pressure than the fluidized particles in the storage vessel and a withdrawal conduit connected from the point between the particular level and the outlet of the storage vessel to the drum, and the decreasing means comprises a return line from the drum at a point above the withdrawal conduit to the storage vessel above the particular level of fluidized particles and means for introducing an elutriating gas into the drum at a point below the withdrawal conduit to lift fines entering the drum from the withdrawal conduit up through the return line to the storage vessel.

12. The apparatus of claim 11, additionally comprising a plurality of disc-shaped plates in the drum disposed between the point of introduction of the elutriating gas and the withdrawal conduit and a plurality of rings interleaved with the plates to improve mixing of the elutriating gas with particles leaving the withdrawal conduit.

13. The apparatus of claim 12, additionally comprising a control valve in the withdrawal conduit.

14. The apparatus of claim 13, additionally comprising means for fluidizing particles in the drum.

15. The apparatus of claim 14, additionally comprising means for introducing a water mist into the fluidized particles in the drum as a quench.

16. The apparatus of claim 15, in which the changing means also comprises means for increasing the first percentage.

17. The apparatus of claim 1, in which the changing means comprises means for alternatively increasing the first percentage and decreasing the second percentage.

18. The apparatus of claim 1, additionally comprising a cooling drum at a pressure lower than the fluidized particles in the storage vessel and the removing means comprises a withdrawal conduit connected from the point between the particular level and the outlet of the storage vessel to the cooling drum.

19. The apparatus of claim 18, additionally comprising means for fluidizing particles in the cooling drum to a particular level, and means for introducing a water mist into the fluidized particles as a quench.

20. The apparatus of claim 19, in which the drum has an outlet near its bottom, the apparatus additionally comprising a trim cooler, means for connecting the outlet of the cooling drum to the trim cooler, means for venting the top of the trim cooler, means for fluidizing particles in the trim cooler, and means for removing particles from the trim cooler.

21. A method for controlling the size of fluidized particles leaving the outlet of apparatus comprising a particle storage vessel having an opening near its bottom that defines the outlet and a cyclone particle separator having an entrance lying above the storage vessel for receiving fluid and entrained particles including fines, a fluid exit, and a particle exit within the storage vessel, which method comprising the steps of:

a. introducing the fluid and entrained particles including fines tangentially to the entrance of the particle separator to impart angular motion to the fluid and particles and separating particles from the fluid with a first percentage of fines being entrained in the fluid by centrifugal force, the fluid with the first percentage of the fines entrained therein flowing to the fluid exit and the particles minus the entrained first percentage of the fines passing through the particle exit to the storage vessel;

b. fluidizing the particles in the storage vessel to a particular level above the outlet;

c. removing a portion of fluidized particles including a second percentage of the fines through a conduit extending into the fluidized particles at a point in the storage vessel between the particular level and the outlet and returning a portion of the second percentage of fines to the storage vessel;

d. increasing the portion of the second percentage of fines returned to the storage vessel when the quantity of fines included in the fluid entrained particles introduced to the particle separator decreases below a desired level; and e. decreasing the portion of the econd percentage of fines returned to the storage vessel when the quantity of fines included in the fluid entrained particles introduced to the particle separator increases above a desired level.

22. A method for controlling the size of fluidized particles leaving the outlet of apparatus comprising a particle storage vessel having an opening near its bottom that defines the outlet, a first cyclone particle separator having an entrance lying above the storage vessel for receiving fluid and entrained particles including fines, a fluid exit, and a particle exit within the storage vessel and a second cyclone particle separator having an entrance coupled to the fluid exit of the first cyclone separator, a fluid exit and a particle exit within the storage vessel, which method comprising the steps of:

a. introducing fluid and entrained particles including fines tangentially to the entrance of the first particle separator to impart angular motion to the fluid and particles;

b. separating a portion of the particles from the fluid, leaving fines entrained in the fluid by centrifugal force;

c. passing the fluid with entrained fines to the second particle separator wherein a portion of the entrained fines are passed to the fluid exit of the second cyclone separator;

d. passing particles separated from the fluid through the particle exits into the storage vessel;

e. fluidizing the particles in the storage vessel to a particular level above the outlet;

f. removing fluidized particles including a percentage of the fines through a conduit extending into the fluidized particles to a point in the storage vessel between the particular level and the outlet;

g. employing the angular motion of the fluid in the separator to decrease the percentage of fines in the fluid flowing to the fluid exit of the second particle separator when the quantity of fines included in the fluid entrained particles introduced to the entrance of the particle separator decreases below the desired level; and h. returning a portion of the percentage of the fines withdrawn by the conduit to the storage vessel when the quantity of fines included in the fluid entrained particles introduced to the first particle separator decreases below a desired level.

23. A method for controlling the size of fluidized particles leaving the outlet of apparatus comprising a particle storage vessel having an opening near its bottom that defines the outlet, a first cyclone particle separator having an entrance lying above the storage vessel for receiving fluid and entrained particles including fines, a fluid exit, and a particle exit within the storage vessel, and a second cyclone particle separator having an entrance coupled to the fluid exit of the first cyclone separator, a fluid exit and a particle exit within the storage vessel, which method comprising the steps of:

a. introducing fluid and entrained particles including fines tangentially to the entrance of the first particle separator to impart angular motion to the fluid and particles;

b. separating a portion of the particles from the fluid leaving the fines entrained in the fluid by centrifugal force;

c. passing the fluid with the entrained fines to the second particle separator wherein a portion of the entrained fines are passed to the fluid exit of the second cyclone separator;

d. passing particles separated from the fluid through the particle exits into the storage vessel;

e. fluidizing the particles in the storage vessel to a particular level above the outlet;

f. removing fluidized particles including a percentage of fines through a conduit extending into the fluidized particles to a point in the storage vessel between the particular level and the outlet; and g. returning a portion of the percentage of fines withdrawn by the conduit to the storage vessel when the quantity of fines included in the particles introduced to the first particle separator decreases below a desired level.

24. A method for controlling the size of fluidized particles leaving the outlet of apparatus comprising a particle storage vessel having an opening near its bottom that defines the outlet and a cyclone particle separator having an entrance lying above the storage vessel for receiving fluid and entrained particles including fines, a fluid exit, and a particle exit within the storage vessel, which method comprising the steps of:

a. introducing fluid and entrained particles including fines tangentially to the entrance of the particle separator to impart angular motion to the fluid particles and separating particles from the fluid with a first percentage of fines being entrained in the fluid by centrifugal force, the fluid with the first percentage of the fines enrained therein flowing to the fluid exit and the particles minus the entrained first percentage of the fines passing through the particle exit to the storage vessel;

b. fluidizing the particles in the storage vessel to a particular level above the outlet;

c. removing fluidized particles including a second percentage of the fines through a conduit extending into the fluidized particles to a point in the storage vessel between the particular level and the outlet;

d. disrupting the angular motion of the fluid in the separator to increase the percentage of fines in the fluid flowing to the fluid exit when the quantity of fines included in the fluid entrained particles introduced to the particle separator increases above a desired level; and e. returning a portion of the second percentage of the fines withdrawn by the conduit to the storage vessel when the quantity of fines included in the fluid entrained particles introduced to the particle separator decreases below a desired level.

25. The method of claim 24, in which the disrupting step comprises introducing gas at a low flow rate into the cyclone particle separator.

26. The method of claim 24, in which the disrupting step comprises raising the particular level of the fluidized particles in the storage vessel above the particle exit of the cyclone particle separator within the storage vessel.

27. A method for controlling the size of fluidized particles leaving the outlet of apparatus comprising a particle storage vessel having an opening near its bottom that defines the outlet and a cyclone particle separator having an entrance lying above the storage vessel for receiving fluid and entrained particles including fines, a fluid exit, and a particle exit within the storage vessel, which method comprising the steps of:

a. introducing the fluid and entrained particles including fines tangentially to the entrance of the particle separator to impart angular motion to the fluid and particles and separating particles from the fluid with a first percentage of fines being entrained in the fluid by centrifugal force, the fluid with the first percentage of the fines entrained therein flowing to the fluid exit and the particles minus the entrained first percentage of the fines passing through the particle exit to the storage vessel;

b. fluidizing the particles in the storage vessel to a particular level above the outlet;

c. removing fluidized particles including a second percentage of the fines through a conduit extending into the fluidized particles to a point in the storage vessel between the particular level and the outlet;

d. employing the angular motion of the fluid in the separator to decrease the first percentage of fines in the fluid flowing to the fluid exit when the quantity of fines included in the fluid entrained particles introduced to the particle separator decreases below the desired level; and e. returning a portion of the second percentage of the fines withdrawn by the conduit to the storage vessel when the quantity of fines included in the fluid entrained particles introduced to the particle separator decreases below a desired level.

28. A method for controlling the size of fluidized particles leaving the outlet of apparatus comprising a particle storage vessel having an opening near its bottom that defines the outlet and a cyclone particle separator having an entrance lying above the storage vessel for receiving fluid and entrained particles including fines, a fluid exit, and a particle exit within the storage vessel, which method comprising the steps of:

a. introducing the fluid and entrained particles including fines tangentially to the entrance of the particle separator to impart angular motion to the fluid particles and separating particles from the fluid with a first percentage of fines being entrained in the fluid by centrifugal force, the fluid with the first percentage of the fines entrained therein flowing to the fluid exit and the particles minus the entrained first percentage of the fines passing through the particle exit to the storage vessel;

b. fluidizing the particles in the storage vessel to a particular level above the outlet;

c. removing fluidized particles including a second percentage of the fines through a conduit extending into the fluidized particles to a point in the storage vessel between the particular level and the outlet; and d. returning a portion of the second percentage of the fines withdrawn by the conduit to the storage vessel when the quantity of fines included in the fluid entrained particles introduced to the particle separator decreases below a desired level.

29. A method for controlling the size of fluidized particles leaving the outlet of apparatus comprising a particle storage vessel having an opening near its bottom that defines the outlet and a cyclone particle separator having an entrance lying above the storage vessel for receiving fluid and entrained particles including fines, a fluid exit, and a particle exit within the storage vessel, which method comprising the steps of:

a. introducing fluid and entrained particles including fines tangentially to the entrance of the particle separator to impart centrifugal force thereto by angular motion of the fluid and particles and separating particles from the fluid with a first percentage of fines being entrained in the fluid by selected disturbance to the angular motion, the fluid with the first percentage of the fines entrained therein flowing to the fluid exit and the particles minus the entrained first percentage of the fines passing through the particle exit to the storage vessel;

b. fluidizing the particles in the storage vessel to a particular level above the outlet;

c. removing fluidized particles including a second percentage of fines through a conduit extending into the fluidized particles to a point in the storage vessel between the particular level and the outlet;

d. increasing the percentage of fines in the fluid flowing to the fluid exit when the quantity of fines included in the fluid entrained particles introduced to the particle separator increases above a desired level; and e. decreasing the percentage of fines flowing to the fluid exit when the quantity of fines included in the fluid entrained particles introduced to particle separator decreases to below a desired level.

30. The method of claim 29 in combination with returning a portion of the second percentage of the fines withdrawn by the conduit to the storage vessel when the quantity of fines included in the fluid entrained particles introduced to the particle separator decreases below a desired level.

31. The method of claim 29 in which the percertage of fines in the fluid flowing to the fluid exit is increased by introducing gas at a low flow rate into the cyclone particle separator.

32. The method of claim 29 in which the percentage of fines flowing to the fluid exit is increased by raising the particular level of the fluidized particles in the storage vessel up above the paticle exit of the cyclone particle separator within the storage vessel.

33. A method for controlling the size of fluidized particles leaving the outlet of apparatus comprising a particle storage vessel having an opening near its bottom that defines the outlet, a first cyclone particle separator having an entrance lying above the storage vessel for receiving fluid and entrained particles including fines, a fluid exit, and a particle exit within the storage vessel and a second cyclone particle separator having an entrance coupled to the fluid exit of the first cyclone separator, a fluid exit and a particle exit within the storage vessel, comprising the steps o:

a. introducing fluid and entrained particles including fines tangentially to the entrance of the first particle separator to impart angular motion to the fluid and particles;

b. separating a portion of the particles from the fluid, leaving fines entrained in the fluid by centrifugal force;

c. passing the fluid with the entrained fines to the second particle separator wherein a portion of the entrained fines are passed to the fluid exit of the second cyclone separator;

d. passing particles separated from the fluid through the particle exits into the storage vessel;

e. fluidizing the particles in the storage vessel to a particular level above the outlet;

f. removing fluidized particles including a percentage of the fines through a conduit extending into the fluidized particles to a point in the storage vessel between the particular level and the outlet;

g. disrupting the angular motion of the fluid in the separator to increase the percentage of fines in the fluid flowing to the fluid exit of the second particle separator when the quantity of fines included in the fluid entrained particles introduced to the entrance of the first particle separator increases above a desired level; and h. returning a portion of the percentage of the fines withdrawn by the conduit to the storage vessel when the quantity of fines included in the fluid entrained particles introduced to the first particle separator decreases below a desired level.

34. The method of claim 33 in which the disrupting step comprises introducing gas at a low flow rate into the second cyclone particle separator.

35. The method of claim 33 in which the disrupting step comprises raising the particular level of the fluidized particles in the storage vessel to above the particle exits of the cyclone particle separators in the storage vessel.

* * * * *

UNITED STATES PATENT AND TRADEMARK OFFICE

CERTIFICATE OF CORRECTION

PATENT NO. : 4,055,486

DATED : October 25, 1977

INVENTOR(S) : Charles K. Choi and Joseph P. Tassoney

It is certified that error appears in the above-identified patent and that said Letters Patent are hereby corrected as shown below:

Column 3, line 19, for "pyrolysis" read -- pyrolyzing --. Column 5, line 66, for "paticles" read -- particles --; line 67, for "feedtine" read -- feedline --. Column 6, line 37, for "25" read -- 26 --; line 41, for "lgs/" read -- lbs/ --. Column 9, line 12, for "at" read -- to --; line 21, for "econd" read -- second --. Column 12, line 68, for "o" read -- of --.

Signed and Sealed this

*Sixth* Day of *June 1978*

[SEAL]

*Attest:*

RUTH C. MASON
*Attesting Officer*

DONALD W. BANNER
*Commissioner of Patents and Trademarks*